United States Patent [19]

Berrill et al.

[11] 4,404,700

[45] Sep. 20, 1983

[54] MACHINE FOR LASTING SIDE PORTIONS OF SHOES

[75] Inventors: William H. Berrill; Frank C. Price, both of Leicester, England

[73] Assignee: USM Corporation, Farmington, Conn.

[21] Appl. No.: 342,713

[22] Filed: Jan. 25, 1982

[30] Foreign Application Priority Data

Jan. 26, 1981 [GB] United Kingdom ..... 8102296

[51] Int. Cl.[3] ..... A43D 21/00; A43D 89/00; A43D 3/00

[52] U.S. Cl. ..... 12/12; 12/33.6; 12/127

[58] Field of Search ..... 12/12, 33.6, 125, 126, 12/127

[56] References Cited

U.S. PATENT DOCUMENTS

| | | | |
|---|---|---|---|
| 3,651,526 | 3/1972 | Ogawa | 12/12 |
| 3,758,904 | 9/1973 | Kamborian et al. | 12/12 |
| 4,120,063 | 10/1978 | Vornberger et al. | 12/12 |

*Primary Examiner*—Patrick D. Lawson

*Attorney, Agent, or Firm*—Donald N. Halgren

[57] ABSTRACT

The machine comprises a shoe support (20) on which a shoe can be positioned, and which includes a toe end engaging member (48) which senses the shoe length, two abutment faces (84, 90) being set along shoe length sensed. The machine also comprises adhesive-applying nozzles (262) and side lasting rolls (224) mounted on a carriage (216) for movement relative to the last support. The "start" position of the nozzles is set by valves (334,336) actuated by cams (330, 332) positioned by a sensing member (326) engaging with one abutment face (84). Various other machine operations, which take place at the ball region of the shoe bottom, the position of which region thus varies proportionately with shoe length, are controlled by further valves (354, 356) actuated by cams (350, 352) carried on a control rod (344) the position of which is determined by a sensing member (338) engaging the other abutment face (90), an appropriate length grading arrangement (342) connecting said member and said control rod. The position of the abutment face (84) can be adjusted by the operator to accommodate different shoe styles.

14 Claims, 3 Drawing Figures

122
120
100
102
20
48
186
188
106
58
192
32
30
104
194
56
190
26
108
III
III
14
34
196
24
52
46
54
118
114
60
42
50
44
76
80
116
194
38
40
36
74
78
88
82
84
208
18
38
40
22
184
62
92
86
18
90
64
98
194
112
198
200
18
200
204
66
198
202
68
28
16
110
96
72
94
182
70

MACHINE FOR LASTING SIDE PORTIONS OF SHOES

BACKGROUND OF THE INVENTION (1) Field of the Invention

This invention is concerned with a machine for lasting side portions of shoes. The term shoe where used herein is used generically as indicating articles of outer footwear generally, and as including an article of outer footwear in the course of its manufacture.

(2) Prior Art

A machine for lasting side portions of shoes is commercially available, comprising a shoe support for supporting, bottom uppermost, a shoe comprising an upper mounted on a last and an insole on the bottom thereof, two side lasting assemblies, arranged one at either side of the last support, and two adhesive applying nozzles, relative movement taking place between the nozzles and the last support whereby adhesive can be applied by the nozzles progressively along opposite side portions of the shoe bottom prior to the operation of the lasting assemblies thereon. In said machine, furthermore, the shoe support comprises a heel support, toe end support means, including a toe end engaging member, movable towards the heel support to bring the toe end engaging member into an operative position, in which it is in engagement with the toe end of the shoe placed on the heel support, and abutment means including an abutment member which is located in relation to the shoe support according to the operative position of the toe end engaging member, a sensing member being mounted on the machine frame, for sliding movement relative thereto, whereby, as the last support is moved into an operative position, the sensing member is positioned in relation to the machine frame by engagement thereof by the abutment member. In the operation of the machine, furthermore, the relative movement between the nozzles and the last support is terminated and reversed by valve means actuated by actuator means therefor during such movement, the arrangement being such that said valve means and actuator means are mounted one on the sensing member and the other for movement relative thereto, as relative movement is effected between the nozzles and the last support as aforesaid. More specifically, in said machine, the shoe support is mounted for movement from a loading position to an operative position, and thereafter the shoe support is mounted on a carriage, which is movable to effect movement of the shoe support, with the shoe thereon, relative to the nozzles as aforesaid.

Each side lasting assembly of said machine, furthermore, comprises a lasting roll which is rotatable about an axis extending widthwise of the shoe bottom and comprises a wiping element disposed helically about the circumference thereof, each roll being arranged to track along a side portion of the shoe bottom immediately following the application of adhesive thereto by the nozzle associated with said lasting roll. The lasting rolls are again mounted on the machine frame and movement of the carriage on which the shoe support is mounted is effective to cause relative movement to take place between the lasting rolls and the shoe bottom. The machine also comprises control means whereby the angular relationship between each lasting roll and the shoe bottom can be varied, to accommodate changes in the control of the shoe bottom. Furthermore, it has been proposed in such a machine that the nozzles and lasting rolls be mounted on a carriage for movement in a direction extending widthwise of the shoe bottom to be operated upon, whereby to control the initial position of the nozzles, widthwise of the shoe bottom, prior to being brought into engagement with the shoe bottom, and also it has been proposed that the speed of relative movement between the shoe support and the nozzles and lasting rolls in a direction extending lengthwise of the shoe bottom be varied during the course of such movement, thus to enable a more uniform amount of adhesive to be applied, depending upon the contour of the shoe bottom, and be more reliably lasted by the lasting rolls.

In the commercially available machine, furthermore, the variation of the angular relationship between the lasting rolls and the shoe bottom is arranged to take place at the ball region of the shoe, and it will be appreciated that the position of the ball region of the shoe on the shoe support varies proportionately with the overall length of the shoe. To this end, the position of the abutment member on the shoe support is such that it moves proportionately to the toe end engaging member, in a relationship equivalent to the proportionate variation of the ball region in relation to the shoe length. For positioning the nozzle at the start of their operation, on the other hand, this is a fixed distance from the toe end of the shoe, according to the size of toe lasting plate which has been used in a previous toe lasting operation. Consequently, it is not desired that the nozzle-start position be determined as a proportion of the length of the shoe, but rather at a fixed position from the toe end. To this end, therefore, the valve means and actuator means therefor referred to above are positioned by the abutment member operating through a grading mechanism, which is effective to scale up the movement of the abutment member to equal the full amount of movement of the toe end engaging member.

Whereas this arrangement operates satisfactorily and furthermore the general construction arrangement of the machine leads to a satisfactory cycle time, it has been considered desirable to separate out the various setting up functions of the machine, and at the same time to improve on the cycle time, and it is therefore an object of the present invention to provide an improved side lasting machine in which such objectives are achieved.

BRIEF SUMMARY OF THE INVENTION

The invention thus provides a machine for lasting side portions of shoes comprising a shoe support for supporting, bottom uppermost, a shoe comprising an upper mounted on a last and an insole on the bottom thereof, two side lasting assemblies, arranged one at either side of the last support, and two adhesive-applying nozzles mounted on a carriage for movement relative to the last support whereby adhesive can be applied thereby progressively along opposite side portions of the shoe bottom prior to operation of the side lasting assemblies thereon, wherein the shoe support comprises a heel support, toe end support means, including a toe end engaging member, movable towards the heel support to bring the toe end engaging member into an operative position, in which it is in engagement with the toe end of a shoe placed on the heel support, and abutment means including an abutment member which is operatively connected with the toe end engaging member and positioned according to the operative position thereof, and wherein a sensing member is mounted on the carriage, for sliding movement relative thereto, and is resiliently urged into a projecting condition thereon, the arrangement being such that, as the carriage is advanced towards the last support, with the sensing member in its projecting condition, said member engages the abutment member and its movement is arrested thereby, said member thus being held against further movement during the remainder of the advancing movement of the carriage, and further wherein the advancing movement of the carriage is terminated and reversed by valve means actuated by actuator means therefor during such advancing movement, the arrangement being such that said valve means and actuator means are mounted one on the sensing member and the other for movement with the carriage. By this arrangement, it will be appreciated that the setting up operation now takes place during the movement of the various integers of the machine to their start position, and the operating cycle of the machine is initiated as a function of the setting up operation.

With this latter consideration in mind, furthermore, conveniently the valve means comprises a first valve, actuation of which arrests the advancing movement of the carriage and causes the nozzles to be lowered into engagement with a central portion of the shoe bottom, whereafter such advancing movement is continued until actuation of a second valve of said valve means, such actuation causing the advancing movement to be terminated, the nozzles to be moved outwardly towards the shoe bottom margin, and movement of the carriage in a reverse direction to be initiated, whereby the nozzles are caused to apply adhesive progressively along the side portions of the shoe bottom as aforesaid.

In order, furthermore, to accommodate different styles of shoe, especially at the toe end thereof, it may be desired to vary the shape and size of the toe lasting plates used in a previous toe lasting operation, so that the start position of the nozzles, in the machine in accordance with the invention, must be varied. To this end, therefore, preferably the abutment member is connected to the toe end engaging member through a support which can thus be positioned according to the operative position of the abutment member and on which the abutment member is mounted for adjusting movement by the operator. More especially, the abutment member may be mounted for rocking movement on the support therefor, a ratchet arrangement being provided for holding the member in adjusted position on the support, and the rocking movement facilitating disengagement of the ratchet arrangement to enable adjustment of the abutment member to take place.

As with the commercially available machine referred to above, preferably the side lasting assemblies of the machine in accordance with the invention each comprise a lasting roll which is rotatable about an axis extending widthwise of the shoe bottom and comprises a wiping element disposed helically about the circumference thereof, each roll being arranged to track along a side portion of the shoe bottom immediately following the application of adhesive thereto by the nozzle associated with said lasting roll. In the machine in accordance with the invention, furthermore, the side lasting assemblies may also be mounted on the carriage by which the nozzles are supported. In addition, where the side lasting assemblies are so constituted, preferably control means is provided whereby the angular relationship between each lasting roll and the shoe bottom can be varied, to accommodate changes in the contour of the shoe bottom, said control means comprising a further sensing member, mounted for movement independently of the carriage, and engageable with a further abutment member forming part of the abutment means, which further sensing member is brought into engagement with said further abutment member when movement of the carriage is initiated as aforesaid, a carrier member, which is connected, through a grading arrangement, with said further sensing member, and the position of which in relation to the shoe bottom is determined by the toe end engaging member, but modified by the grading arrangement, valve means, actuation of which senses the angular relationship between the lasting rolls and shoe bottom to be varied as aforesaid, and actuator means for said valve means, said valve means and said actuator means being mounted one on said carrier member and the other for movement with the carriage. It will thus be appreciated that grading is now separated from the function of the first-mentioned abutment member, which can now be set according to the size of the wiper plates of the preceding toe lasting operation without regard for any control function which must take place at the ball region of the shoe being operated upon in the machine in accordance with the invention.

In addition, the carriage may now also be movable in a direction extending widthwise of the shoe bottom to be operated upon, whereby to control the initial position of the nozzles widthwise of the shoe bottom, prior to being brought into engagement with the shoe bottom, and also the position of the lasting rolls, widthwise of the shoe bottom, as they are caused to operate therealong as aforesaid, fluid pressure operated means being provided for thus moving the carriage. In such a case, furthermore, operation of said fluid pressure operated means may also be controlled by said control means, the control means comprising further valve means, by which the supply of pressure fluid to said fluid pressure operated means is controlled, and actuator means for the valve means, and said valve means and actuator means being mounted one on said carrier member and the other for movement with the carriage. Similarly, the speed of movement of the carriage in a direction extending lengthwise of the shoe bottom may also be varied during the course of such movement under the control of fluid pressure operated speed control means. In this case also, operation of the speed control means is preferably controlled by said control means comprising a further sensing member, mounted for movement independently of the carriage, and engageable with a further abutment member forming part of the abutment means, which further sensing member is brought into engagement with said further abutment member when movement of the carriage is initiated as aforesaid, a carrier member which is connected, through a grading arrangement, with said further sensing member, and the position of which in relation to the shoe bottom is determined by the toe end engaging member, but modified by the grading arrangement, valve means, which controls the supply of pressure fluid to the speed control means, and actuator means for said valve means, said valve means and actuator means being mounted one on said carrier member and the other for movement with the carriage.

Thus, it will be appreciated that each of the operations of the machine in accordance with the invention which are to take place at the ball region of the shoe bottom are under the control of the further abutment member and its associated parts. In the particular embodiment of the invention, furthermore, conveniently fluid pressure operated means is provided by which the carrier member can be moved in a direction parallel with that of the movement of the carriage, and wherein the grading arrangement comprises a lever to which the carrier member is connected, at a position intermediate the length of the lever, and the lever is mounted at one end on a frame portion of the machine for pivotal movement thereon, while its other end is pivotally connected to the further sensing member the arrangement being such that movement of the carrier member is limited by engagement of the further sensing member with the further abutment member, the ratio between such movement of the carrier member and that of the further sensing member being the same as the ratio between the distance between the pivot point of the lever and the points along the length of the lever at which respectively the carrier member and further sensing member are connected to the lever. Preferably, furthermore, the further sensing member is advanced into engagement with the further abutment member after the carriage has been advanced to bring the first-mentioned sensing member into engagement with the first-mentioned abutment member.

The machine in accordance with the invention may also comprise further control means whereby, as the carriage is moved in a opposite direction, the nozzles are moved heightwise of the shoe bottom, out of engagement therewith, and movement of the carriage in said opposite direction is arrested said further control means comprising valve means and actuator means therefor, the relative positions of which remain unaffected by the setting of the abutment means. Where the side lasting assemblies comprise lasting rolls as aforesaid, furthermore, said further control means may also be effective to move the lasting rolls heightwise of the shoe bottom, out of engagement therewith, after the nozzles have been moved heightwise as aforesaid. In addition, in order to accommodate different shoe styles, and more especially in order to cater for e.g. sling back shoes, where the side lasting operation does not extend as far towards the heel seat as in closed back shoes, the further control means is preferably manually adjustable.

BRIEF DESCRIPTION OF THE DRAWINGS

There now follows a detailed description, to be read with reference to the accompanying drawings, of one machine in accordance with the invention, which machine has been selected for description merely by way of exemplification of the invention and not by way of limitation thereof.

In the accompanying drawings.

DESCRIPTION OF THE PREFERRED EMBODIMENTS

Figure 1:
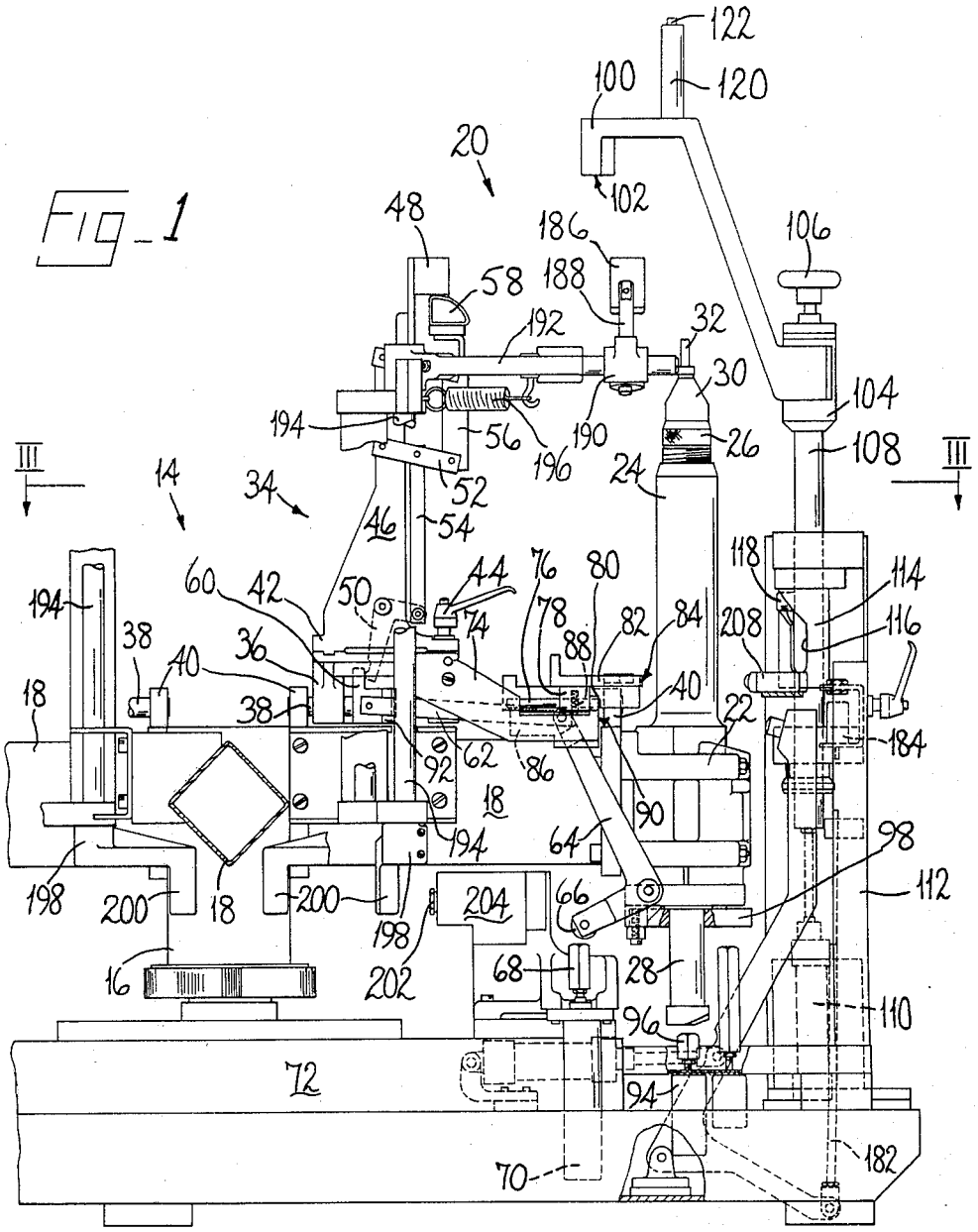
FIG. 1 is a view in side elevation of a shoe support of the machine in accordance with the invention.
Figure 2:
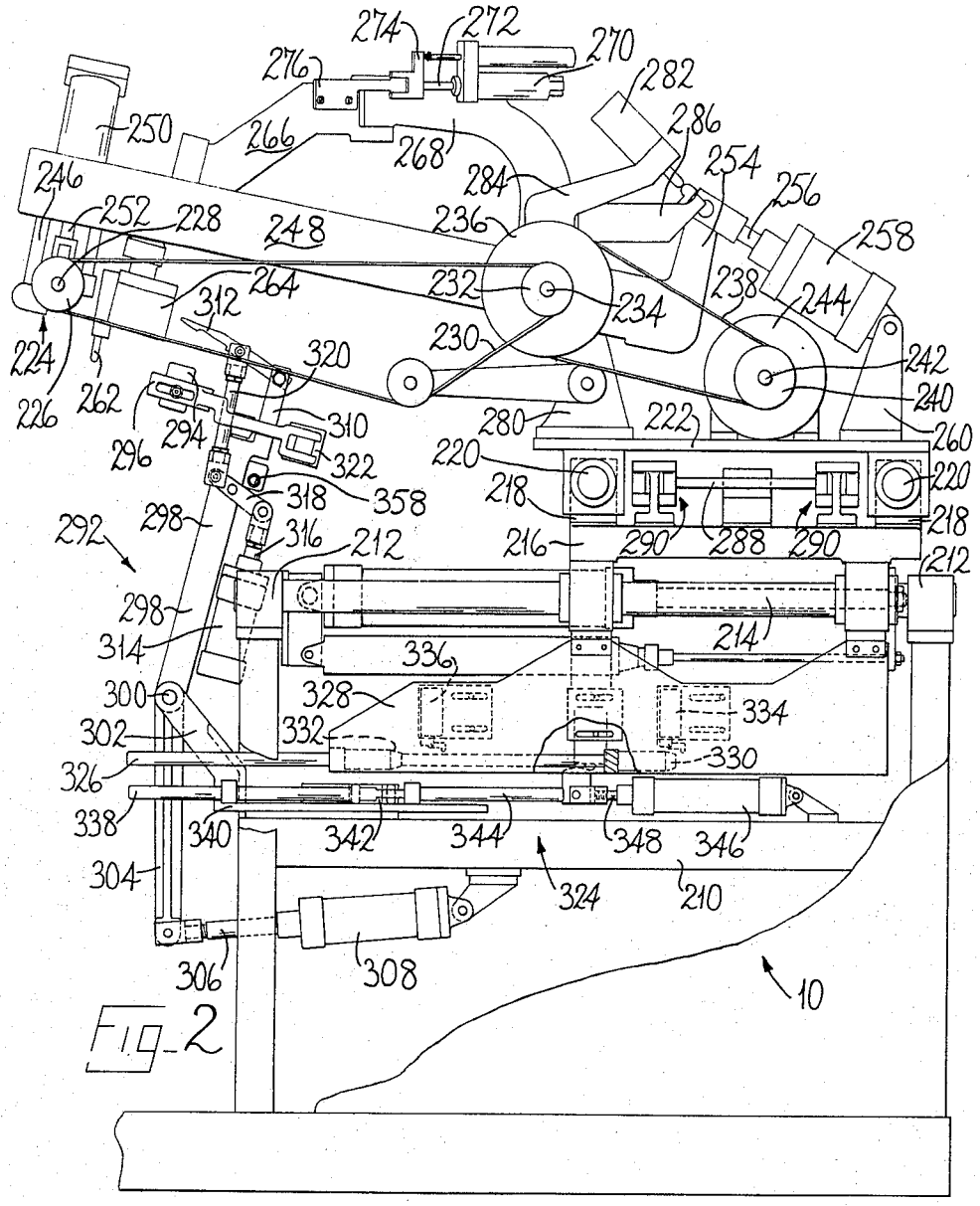
FIG. 2 is a side view of the machine in accordance with the invention.
Figure 3:
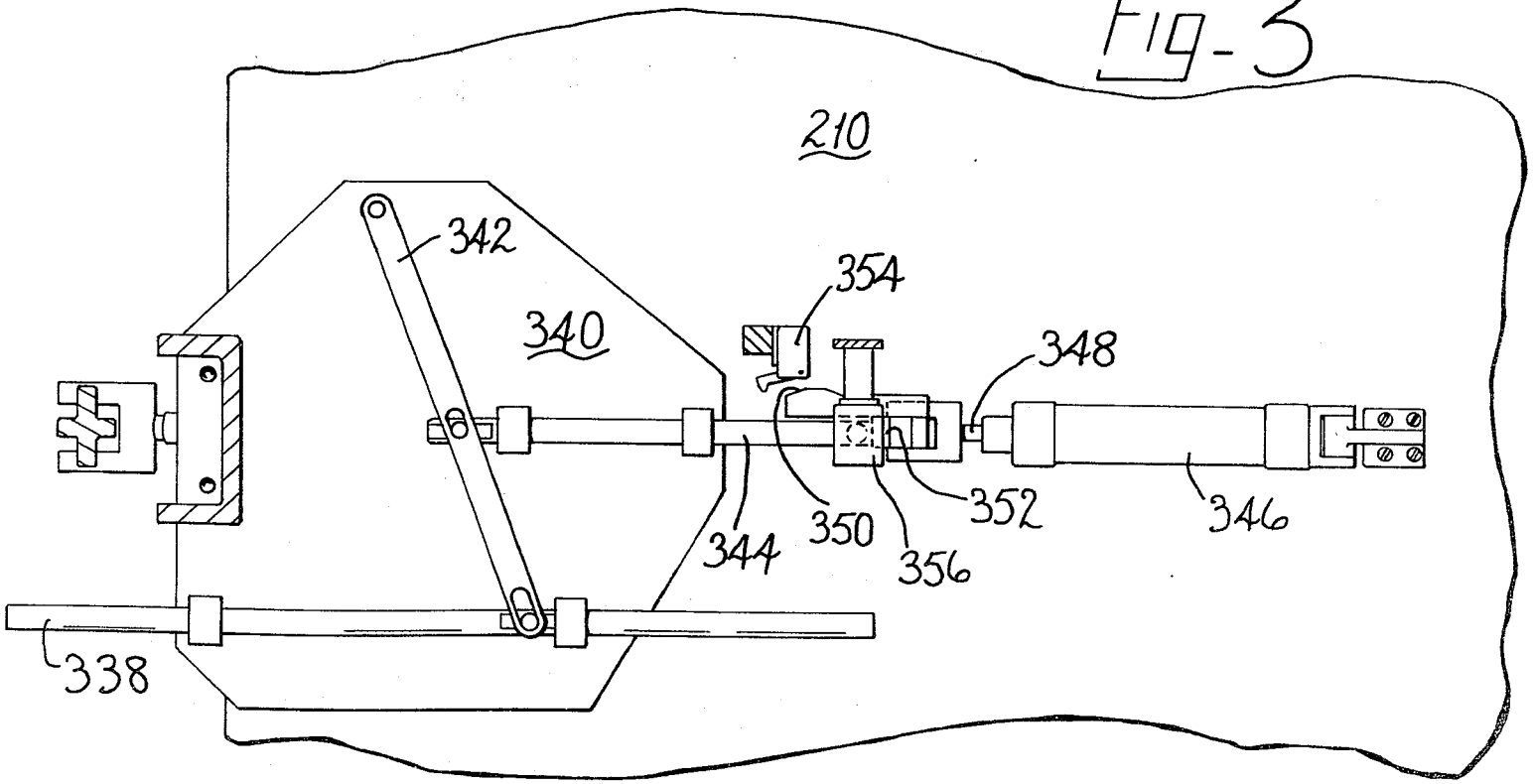
FIG. 3 is a fragmentary plan view showing a grading arrangement used in said machine.

The machine in accordance with the invention, which is a machine for lasting side portions of shoes, forms part of an apparatus for lasting heel seat and side portions of shoes, which apparatus comprises a transporting device having a loading station and three operating stations, at a first of which the side lasting machine is arranged. The device comprises a turret arrangement having four arms 18 arranged in cross-form, each arm supporting a last support generally designated 20. Each last support comprises, bolted to an outward end thereof, a mounting 22 including an upwardly extending sleeve portion 24, an upper end of which has an adjustable threaded collar portion 26, for a heightwise slidable rod 28 carrying a heel support member 30 with an upwardly projecting last pin 32.

Each last support 20 also comprises toe support means generally designated 34 comprising a carriage 36 mounted for sliding movement, towards and away from the sleeve portion 24, on two rods 38 carried by upstanding plates 40 secured to opposite ends of the arm 18. The carriage 36 has a transverse groove accommodating a slide plate 42, locking means 44, including a clamp screw and a slot, being provided for locking the slide plate in adjusted widthwise position. (In this way, the toe support means can be set for a left or a right shoe; desirably the last supports are so set up that left and right shoes are presented alternately to each station.) Upstanding from the slide plate are two support plates 46, on upper end portions of which is carried a V-shaped toe end engaging member 48. Also mounted between the support plates 46 is a bell crank lever 50 parallel with an upper arm of which are two parallel levers 52, a link 54 extending between the upper arm of the bell crank lever and said further levers, thus forming a parallel linkage arrangement. Supported between end portions of the levers 52, furthermore, is a support post 56 for a toe pad member 58, which is arranged to engage a toe cap portion of a shoe supported on the last support and located by the toe end engaging member 48.

In the operation of the machine, the toe support means 34 is moved towards the heel support member 30 along the rods 38 until the toe end engaging member 48 engages with the shoe toe, whereupon further movement towards the heel support is terminated. For effecting such movement, a downwardly depending arm of the bell crank lever 50 engages a projection on a block 60 slidable on the rods 38 independently of the carriage 36, there being connected at one end of said block 60 a link 62 connected at its opposite end to one arm of a bell crank lever 64 mounted for pivotal movement on the mounting 22 of the last support. The other arm of the bell crank lever 64 carries a roller 66 which can be engaged by a pusher block 68 carried on a piston rod of a piston-and-cylinder arrangement 70 (constituting first power means of the transporting device) mounted on a frame portion 72 of the transporting device, actuation of said arrangement 70 causing the pusher block to engage the roller and thus to draw the block 60 towards the heel support. Upon termination of movement towards the heel support of the toe end engaging member as aforesaid, continued operation of the arrangement 70 is effective through the parallel linkage arrangement to raise the toe pad 58 into engagement with the shoe.

The toe end engaging member 48 forms part of shoe length sensing means, the position of which is set at the loading station A according to the position of said member 48 in engagement with the shoe to be operated upon. Secured to the carriage 36 of each last support 20 is an arm 74 projecting towards the heel support and carrying a slide rod 76 on which a block 78 is slidable, said block carrying a metal strip 80 and also an abutment member 82 an end face 84 of which, facing the heel support, constitutes an abutment face. Secured to the arm 74, beneath the strip 80, is a block 86, and the block 86 and strip 80 are provided with meshing serrations, which, when in mesh, prevent relative movement between the abutment member 80 and arm 74. A spring-urged plunger 88 is captive in the block 78 and urges the serrations into meshing engagement, the block being capable of rocking on the rod 76 to disengage the serrations, to allow the position of the member 82 to be adjusted lengthwise of the shoe bottom. The meshing serrations thus constitute a ratchet arrangement for locking the abutment member 82 in adjusted position.

The lengthwise position of the abutment member 82 can thus be set by the operator, merely by releasing the strip 80 from meshing engagement and then sliding it, together with the abutment member 82, along the slide rod 76, the serrations thereafter serving to lock it in adjusted position. By varying the position of the abutment member 82, furthermore, the abutment face 84 can be set according to the style of shoe being operated upon. (In practice the position of the abutment member 82 will be set according to the size of the wiper plates used in a previous toe lasting operation, and thus according to the amount of the shoe which has thus been lasted.)

In addition, an end face 90 of the arm 74 provides a further abutment face, the position of which is determined by the position to which the toe end engaging member 48 is moved as aforesaid.

For locking the toe support means in adjusted position, a plate 92 is slidable on one of the rods 38 and is connected to a heelward face of the block 60 whereby to constitute a bar lock arrangement, said arrangement allowing the toe support means to move towards the heel support, while preventing movement thereof away from said support.

The rod 28 of each last support 20 is mounted for sliding heightwise movement in the sleeve portion 24, thus to bring the heel seat of a shoe supported on the last pin 32 thereof to a datum position. For thus moving the rod 28, there is provided at the loading station A a piston-and-cylinder arrangement 94 a piston rod of which carries a pusher member 96 engageable with a head portion on the lower end of each rod 28. Futhermore, for locking each rod 28 with the heel seat of the shoe in its datum position, a bar lock arrangement is provided comprising a plate 98 which is secured to the under-side of the mounting 22. (The plates 98, 92 respectively constitute first and second locking means of the apparatus.)

For determining the datum position of the heel seat of a shoe at the loading station A, there is provided at said station a heel height determining member 100 in the form of a cranked arm having a downwardly facing heel seat engaging surface 102. The arm 100 is carried by a clock 104 which itself is adjustable heightwise, under the control of the operator, using an adjusting screw 106, at the upper end of a shaft 108 which is movable heightwise under the control of a piston-and-cylinder arrangement 110. The shaft 108 is suppored in a support column 112, which in turn carries a bush portion 114 having a slot 116 therein which is part-helical and part-vertical. The slot 116 receives a pin 118 carried on the shaft 108, which is slidingly accommodated; in the bush portion, so that, as the shaft 108 is moved heightwise, it is rotated between an operative position, in which it is disposed above the last pin 32, and sets the datum position for the heel seat of a shoe supported thereby, and an out-of-the-way position, in which it does not impede the movement of the last supports 20 to and from the loading station A.

For effecting movement of the heel height determining member 100, furthermore, a hand grip 120 thereon has a thumb switch 122 (constituting actuating means). Actuation of the switch 122 is effective, furthermore, not only to bring the member 100 to its operative position, but also to initiate operation of the piston-and-cylinder arrangement 94 (constituting further power means of the apparatus) and also, in sequence, operation of the piston-and-cylinder arrangement 70, thus respectively to raise the rod 28, and last pin 32 therewith, and to initiate heelward movement of the toe support means 34. (It will of course be appreciated that the heel height determining member 100 is moved towards the last support 20 under a higher pressure than that under which the last support 20 is moved heightwise towards the member 100 as aforesaid.)

In addition, each last support 20 also comprises a pair of side clamp members 186, each member being of a plastics material, e.g. polytetrafluoroethylene, and being shaped generally to the side portions of the shoe to be operated upon. Each member 186 is mounted on a post 188 adjustably clamped in a block 190 carried at the end of an arm 192 which is supported at the upper end of a vertical shaft 194, each shaft 194 being carried by the base support 16 of the turret arrangement and by a further collar portion (not shown) carried on said arrangement. Each side clamp member 182, furthermore, is urged by a spring 196 into an out-of-the-way position. For moving the side clamp members into an operative condition, in which they engage with side portions of a shoe to be operated upon, there is carried at the lower end of each shaft 194 an arm 198 having a depending block 200, each block, when the last support 20 is at the loading station, lying in the path of movement of a plunger 202 which is carried, and operated by a piston-and-cylinder arrangement 204, operation of the latter being effective to cause the shafts 194 to rotate to bring the side clamp members 186 supported thereby as aforesaid into operative condition.

The side clamp members 186 are used to assist in the support of the shoe to be operated upon during the lasting operation at the first operating station, and to this end piston-and-cylinder arrangements 206, are also provided at said station, operating in the same member as the piston-and-cylinder arrangements 204 at the loading station. In the case of the arrangements 206, however, the side clamp members 186 are maintained in operative condition during the lasting operation, while at the loading station the arrangements 204 are operated merely to ensure that the side clamp members 186 are properly located on the blocks 190 in relation to the shoe to be operated upon.

With the shoe loaded at the loading station, the turret arrangement is then indexed to bring the shoe to the first operating station at which the side lasting machine in accordance with the invention is arranged. The side lasting machine comprises a main frame 210 including four support blocks 212 arranged two at each side of the machine, each set of two blocks 212 supporting a slide rod 214, the rod 214 extending in a direction lengthwise of the shoe bottom. Mounted for sliding movement on the slide rods 214 is a carriage 216 which itself includes four support clocks 218 arranged two at the front and toe at the back (viewing in the direction of travel along the slide rods 214.) Each set of two blocks 218 supports a slide rod 220, said rods extending widthwise of the shoe bottom. Mounted for movement along the slide rods 220 is a support plate 222 on which side lasting instrumentalities and also adhesive-applying means of the side lasting machines are mounted. The side lasting instrumentalities are in the form of two lasting rolls 224, each roll being rotatable about an axis extending widthwise of the shoe bottom and comprising a wiping element disposed helically about the circumference thereof. For thus rotating each roll, a pulley 226 is mounted on a shaft 228, on which the roll is also mounted, the pulley being operatively connected by means of a timing belt 230 to a drive pulley 232 carried on a shaft 234 which also supports a larger pulley 236 connected by a belt 238 to a further pulley 240 mounted on an output drive shaft 242 of an electric motor 244 carried on the support plate 222. The lasting rolls 224 are each supported in a housing 246 which is mounted, for pivotal movement about an axis extending generally lengthwise of the shoe bottom, in a support frame 248. For effecting such pivotal movement, each housing has associated therewith fluid pressure operated means in the form of a piston-and-cylinder arrangement 250 the cylinder of which is mounted on the support frame and a piston rod 252 of which is connected to the housing. Operation of the piston-and-cylinder arrangements 250 is thus effective to alter the angular relationship between each lasting roll 224 and the shoe bottom, such variation being able to take place during the operating cycle of the machine.

The support frame 248 is mounted for pivotal movement on a cross-shaft 278 which is carried by a bracket 280 mounted on the support plate 222. The cross-shaft extends widthwise of the shoe bottom, its axis coincident with that of the shaft 234. For effecting pivotal movement of the support frame 248, there is operatively connected to a rearward extension 254 thereof a piston rod 256 of a piston-and-cylinder arrangement 258 which is carried on a bracket 260 mounted on the support plate 222. Operation of the piston-and-cylinder arrangement 258 is thus effective to cause the rolls 224 to be moved into and out of operative engagement with the shoe bottom, and also to maintain a resilient pressure on the rolls during the lasting operation.

The adhesive-applying means of the side lasting machine comprises two nozzles 262, each depending from, and supported by, a melt chamber 264, each chamber in turn being carried at a forward end of a carrier arm 266. Each arm 266, furthermore, is mounted, for pivotal movement about an axis extending heightwise of the shoe bottom, on a carrier arm 268, whereby the nozzles can be moved widthwise of the shoe bottom, thus to enable them to follow the contour of the shoe bottom as they are caused to track therealong. The arms 266, and thus the nozzles 262 therewith, can be moved between an initial condition, in which the nozzles are positioned adjacent one another, and an operating condition, in which the nozzles are free to follow the outside contour of the shoe bottom. To this end, each nozzle has associated therewith a piston-and-cylinder arrangement 270, which is carried on its associated support arm 268, and a piston rod 272 of which can be urged into engagement with a bracket 274 mounted on an arm 276 secured to the arm 266. For controlling the position of each arm 266, furthermore, the bracket 274 carries an upstanding pin (not shown) arranged to be engaged by a stop member movable, through a linkage (not shown), by fluid pressure operated means (not shown), between a first position, in which its associated nozzle 262 is urged by the piston-and-cylinder arrangement 270 into its initial condition, and a second position, in which movement of the nozzle is no longer restrained thereby. Each support arm 268, furthermore, is mounted on the cross shaft 278, fluid pressure operated means in the form of two piston-and-cylinder arrangements 282, one associated with each support arm, being provided, each supported on a bracket 284 on the bracket 280, and each acting on a rearwardly extending lever 286 secured through its associated support arm 268. The piston-and-cylinder arrangements 282 are thus effective to cause each nozzle to be moved, independently of the other, heightwise of the shoe bottom.

For moving the support plate 222 along the slide rods 214, fluid pressure operated means is provided, in the form of a piston-and-cylinder arrangement (not shown). Operation of said arrangement is thus effective to cause the nozzles and lasting rolls to track along opposite side portions of the shoe bottom, thus to operate progressively therealong. For moving the support plate 222 widthwise of the shoe bottom, along the slide rods 220, a lever 288 is mounted, by a pivotal connection at its center, on the under-side of the support plate 222, there being connected to each end of said lever a piston-and-cylinder arrangement 290, the arrangement thus being such that, by operating a selected one or both of said arrangement 290, the support plate can be positioned in one of three positions widthwise of the shoe bottom. In this wa, the nozzles and rolls can be positioned in relation to the shoe bottom in one of three widthwise positions so as to ensure that regardless of the shoe bottom shape, the nozzles, in their initial condition, can be brought into engagement with the shoe bottom at a position centrally thereof (considered widthwise), and similarly it can be ensured that the lasting rolls engage the lasting margin of the shoe bottom as they are brought into engagement therewith.

(The mounting of the lasting rolls and nozzles is described in greater detail in the specification our copending U.K. Patent Application No. 8,009,771.)

The side lasting machine 10 also comprises heel end support means generally designated 292 comprising two side clamps 294 supported by two pivoting arms 296 carried by a support post 298. The arms 296 have rearward extension between which is arranged a piston-and-cylinder arrangement 322, thus to cause the side clamps 294 to clamp the heel end of a shoe presented thereto. The support post 298 is itself mounted for pivotal movement, about an axis extending widthwise of the shoe bottom, on a shaft 300 carried on a bracket 302 mounted on the frame 210 of the machine. Also keyed to the shaft 300 is a link 304 to which is secured a piston rod 306 of a piston-and-cylinder arrangement 308 also carried on the main frame 210. The arrangement 308 is thus effective to cause the side clamps 294 to be moved into and out of an operative position in which they can clamp side portions of a shoe presented at the first operating station B. The support posts 298 have an upstanding integral bracket 310 on which is pivotally secured a holddown foot 312. For moving the holddown foot into and out of operative engagement with the bottom of a shoe presented at the first operating station B, a piston-and-cylinder arrangement 314 is carried on the support post 298, an upwardly projecting piston rod 316 thereof being connected, through a lever 318, pivoted on the support post 298, and a link 320, with an intermediate portion of the holddown foot.

For ensuring the correct sequence of operation of the various piston-and-cylinder arrangements of the side lasting machine, conrol means generally designated 324 is provided, which co-operates with the abutment faces 84, 90 associated with the toe support means 34 of the last support 20 presented at the first operating station B. More specifically, for co-operating with the abutment face 84, a rod 326 is mounted on a support plate 328 carried on the carriage 216, the rod 326 being mounted for sliding movement, in a direction lengthwise of the shoe bottom, on said plate. The rod 326 carries a plurality of (in this case two) cam portions 330, 332 arranged to actuate respectively valves 334, 336 mounted on the support plate 328. In the operation of the machine when a last support 20 is presented at the first operating station B (thereby tripping an interlock valve (not shown), the carriage 216 is moved forwardly towards the shoe by operation of the fluid pressure operated means (not shown), the nozzles and lasting rolls at this time being out of operative position. The rod 326, which is spring-urged into a projecting position, engages the abutment face 84 of the abutment member 82 associated with the last support, its movement thus being arrested, whereafter the carriage 216 continues its movement until valve 334 is actuated by the now stationary cam portion 330, actuation of said valve arresting the movement of the carriage 216 and also initiating operation of piston-and-cylinder arrangements 282, whereupon the nozzles are brought into engagement with the shoe bottom. At this time, furthermore, the position of the support plate 222 on the carriage 216 will already have been determind, according to whether it is desired that the nozzles be brought into engagement with the shoe bottom in an offset condition or in a centralized condition, according to the shape of the shoe bottom; this selection can be made by manual operation of an appropriate switch (not shown). Furthermore, since the transporting device is so arranged to present alternately left and right shoes to the various operating stations, if "offset condition" is selected, then the support plate 222 is automatically moved to the appropriate offset position. After a time interval, the movement of the carriage 216 continues until valve 336 is actuated by the cam portion 332, whereupon the carriage movement is again arrested, the nozzles are moved outwardly under the action of piston-and-cylinder arrangements 270, after the stop members associated therewith have been withdrawn (such withdrawal also taking place when valve 336 is actuated), and then the movement of the carriage 216 takes place in a reverse direction, thus to cause the nozzles to begin applying adhesive progressively along opposite side portions of the shoe bottom. When the lasting rolls 224, which are arranged toewardly of the nozzles, reach the point at which adhesive application has begun, they too are brought into engagement with the shoe bottom, by operation of the piston-and-cylinder arrangements 258, and are caused to track progressively along the shoe bottom, thus to cause lasting marginal portions of the upper to be wiped over and pressed against corresponding marginal portions of the insole. In the particular machine now being described, the nozzles 262 engage over edge portions of the insole, whereafter the piston-and-cylinder arrangements 270 act to urge the nozzles inwardly, thereby maintaining them in contact with the edge portion of the insole, which serves in this manner to guide the nozzles appropriately along the insole edge. (It is, however, envisaged within the scope of the present invention that other systems of nozzle guidance may be utilized.)

The control means of the side lasting machine also comprises a further rod 338 arranged to engage the abutment face 90 associated with the last support, as the carriage 216 is moved theretowards as aforesaid. In this case, as best seen in FIG. 5, the rod 338 is mounted for sliding movement, in a direction extending lengthwise of the shoe bottom, in mountings on a plate 340, on which also is mounted a lever 342 for pivotal movement thereon. At an end removed from its pivot, the lever 342 is connected to an intermediate portion of the rod 338. Furthermore, the lever 342 is connected, at an intermediate portion, to a control rod 344 which is also mounted for sliding movement, in a direction parallel to the rod 338, in mountings on the plate 340, fluid pressure operated means in the form of a piston-and-cylinder arrangement 346 being provided, a piston rod 348 of which is connected to the rod 344, for effecting sliding movement of said rod 344, and thus through the lever 342, of the rod 338. The arrangement of the rods 338, 344 and lever 342 constitutes a grading arrangement whereby rod 338 is moved proportionately to rod 334, the proportion of such movement being in the ratio 26:14 (which is generally considered to be the ratio between the overall length of a shoe and the distance of the ball region thereof from the heel end). The control rod 344 has a plurality of (in this case, two) cam portions 350, 352 arranged to actuate respectively valves, 354, 356 mounted on the carriage 216 for movement therewith. Valve 354 is effective, when actuated, to operate piston-and-cylinder arrangements 290 to bring the support plate 222, and thus the lasting rolls supported thereby, to a centralized position, while valve 356 when actuated, is effective to operate piston-and-cylinder arrangements 250 to cause the housings 246 for the lasting rolls 224 to pivot thus to vary the angular relationship of the lasting rolls 224 to the shoe bottom. The timing of both these operations is dependent upon the shoe length (as opposed to the timing of the operations controlled by the rod 326, which are dependent rather upon the size of toe lasting plates which have been used for a prior toe lasting operation), and both operations take place generally in the ball region of the shoe. In the operation of the side lasting machine, piston-and-cylinder arrangement 346 is operated to urge the rod 338 to a projecting position so that, as the carriage 216 is advanced towards the last support presented at the first operating station B, the rod 338 engages the face 90 of the arm 74, and is thereafter maintained in contact with said face during the rearward movement of the carriage. As the carrige moves rearwardly, the valves carried thereby are actuated by the cam portions 350, 352 in sequence, as above described.

Prior to the initiation of the movement of the carriage 216 as aforesaid, the heel end support means is swung about the shaft 300 to bring the support post 298 to a vertical position, whereafter the side clamps 294 are operated to clamp the shoe in the region of the cone of the last. At the same time, the side clamp members 186 associated with the last support 21 are operated to clamp the upper of the shoe against its last in the region of the joint, such operation being under the control of piston-and-cylinder arrangements 206, as above described. At the same time, the holddown member 312 is operated, this member serving to hold the insole against the last bottom during the side lasting operation. Furthermore, associated with the holddown member 312 is a sensor in the form of a valve 358 which, in a normal cycle of operation in which a shoe is on the last post presented to the first operating station, remains unactuated, but which, in the event of no shoe being on said last support, is actuated by the holddown member 312 effecting an overtravel. The valve 358 thus acts as a "no shoe" indicator. In the event of actuation of the valve 358, furthermore, the movement of the carriage 216 towards the last support is interrupted and the carriage is returned to its initial position, without an operating cycle of the machine being effected.

The movement of the carriage 216 in a return direction is terminated by a further valve (not shown) mounted on the frame 210 of the machine and actuated by an actuator (also not shown) mounted on the support plate 328. Actuation of said valve is first effective to raise the nozzles 262 out of engagement with the shoe bottom, and thereafter to raise the lasting rolls 224 out of such engagment, at the same time as the arrest of the movement of the carriage. Furthermore, actuation of said valve is effective to cause the carriage 216 to move again through a limited distance towards the last support, which position then constitutes the rest position of the carriage.

It will be appreciated that the rod 326 constitutes a sensing member, and the valves 334, 336 and cam portions 330, 332 constitute valve means and an actuator therefor, for controlling the movement of the carriage 216. Similarly, the rod 338 constitutes a further sensing member and the control rod 334 a carrier member associated with the grading arrangement, these various integers serving, in combination with the valve 356 and cam portion 352 (constituting valve means and actuator means therefor), to determine the timing of the variation of the angular relationship between each lasting roll and the shoe bottom, while, in combination with the valve 354 and cam portion 350, said integers serve to control the movement of the carriage 216 in a direction extending widthwise of the shoe bottom to be operated upon.

In addition, the control rod 344 may also carry a further cam portion (not shown) for actuating a further valve (also not shown) mounted on the carriage 216, said further valve being arranged to cause the speed at which the carriage 216 is moved in a return direction as aforesaid to be varied during the course of such movement. This facility may be of particular advantage where the contour of the shoe bottom, especially in the joint region thereof, is steeply inclined inwardly so that, for a relatively short amount of lengthwise movement of the carriage 216, the nozzles move at a relatively high rate, because of the extra distance they cover in moving inwardly. At the same time, especially if the shoe is of a high-heeled type, the lasting rolls, in traversing over the joint region, also move at a relatively high rate for a small amount of movement of the carriage. The cam portion and valve just hereinbefore mentioned constitute part of speed control means of the machine.

Whereas the machine in accordance with the invention has just been described forms part of an apparatus including a turret arrangement with a plurality of last supports for successive automatic presentation to the machine, it will be appreciated that in accordance with the invention the machine may comprise a single, fixed, last support located at the operating locality of the machine.

I claim:

1. A machine for lasting side portions of shoes comprising a shoe support for supporting, bottom uppermost, a shoe comprising an upper mounted on a last and an insole on the bottom thereof, two side lasting assemblies, arranged one at either side of the last support, and two adhesive-applying nozzles mounted on a carriage for movement relative to the last support whereby adhesive can be applied thereby progressively along opposite side portions of the shoe bottom prior to operation of the side lasting assemblies thereon;

said shoe support comprises a heel support, toe end support means, including a toe end engaging member, movable towards the heel support to bring the toe end engaging member into an operative position, in which it is in engagement with the toe end of a shoe placed on the heel support, and abutment means including an abutment member which is operatively connected with the toe end engaging member and positioned according to the operative position thereof; and a sensing member mounted on said carriage, for sliding movement relative thereto, and which is resiliently urged into a projecting condition thereon, the arrangement being such that, as the carriage is advanced towards the last support, with the sensing member in its projecting condition, said member engages the abutment member and its movement is arrested thereby, said member thus being held against further movement during the remainder of the advancing movement of the carriage, and further wherein the advancing movement of the carriage is terminated and reversed by valve means actuated by actuator means therefor during such advancing movement, the arrangement being such that said valve means and actuator means are mounted one on the sensing member and the other for movement with the carriage.

2. A machine according to claim 1 wherein the valve means comprises a first valve, actuation of which arrests the advancing movement of the carriage and causes the nozzles to be lowered into engagement with a central portion of the shoe bottom, whereafter such advancing movement is continued until actuation of a second valve of said valve means, such actuation causing the advancing movement to be terminated, the nozzles to be moved outwardly towards the shoe bottom margin, and movement of the carriage in a reverse direction to be initiated, whereby the nozzles are caused to apply adhesive progressively along the side portions of the shoe bottom as aforesaid.

3. A machine according to claim 2 wherein the abutment member is connected to the toe end engaging member through a support which can thus be positioned according to the operative position of the abutment member and on which the abutment member is mounted for adjusting movement by the operator.

4. A machine according to claim 3 wherein the abutment member is mounted for rocking movement on the support therefor, a ratchet arrangement being provided for holding the member in adjusted position on the support, and the rocking movement facilitating disengagement of the ratchet arrangement to enable adjustment of the abutment member to take place.

5. A machine according to claim 4 wherein the side lasting assemblies are also mounted on the carriage, each assembly comprising a lasting roll which is rotatable about an axis extending widthwise of the shoe bottom and comprises a wiping element disposed helically about the circumference thereof, and each roll being arranged to track along a side portion of the shoe bottom immediately following the application of adhesive thereto by the nozzle associated with said lasting roll, and wherein control means is provided whereby the angular relationship between each lasting roll and the shoe bottom can be varied, to accommodate changes in the contour of the shoe bottom, said control means comprising a further sensing member, mounted for movement independently of the carriage, and engageable with a further abutment member forming part of the abutment means, which further sensing member is brought into engagement with said further abutment member when movement of the carriage is initiated as aforesaid, a carrier member, which is connected, through a grading arrangement, with said further sensing member, and the position of which in relation to the shoe bottom is determined by the toe end engaging member, but modified by the grading arrangement, valve means, actuation of which senses the angular relationship between the lasting rolls and shoe bottom to be varied as aforesaid, and actuator means for said valve means, said valve means and said actuator means being mounted one on said carrier member and the other for movement with the carriage.

6. A machine according to claim 4 wherein the carriage is also movable in a direction extending widthwise of the shoe bottom to be operated upon whereby to control the initial position of the nozzles, widthwise of the shoe bottom, prior to being brought into engagement with the shoe bottom, there being provided fluid pressure operated means for thus moving the carriage and control means whereby the operation of said fluid pressure operated means is controlled, said control means comprising a further sensing member, mounted for movement independently of the carriage, and engageable with a further abutment member forming part of the abutment means, which further sensing member is brought into engagement with said further abutment member when movement of the carriage is initiated as aforesaid, a carrier member which is connected, through a grading arrangement, with said further sensing member, and the position of which in relation to the shoe bottom is determined by the toe end engaging member, but modified by the grading arrangement, valve means, which controls the supply of pressure fluid to said fluid pressure operated means, and actuator or means, for said valve means, said valve means and actuator means being mounted one on said carrier member and the other for movement with the carriage.

7. A machine according to claim 5 wherein the carriage is also movable in a direction extending widthwise of the shoe bottom to be operated upon, whereby to control the initial position of the nozzles, widthwise of the shoe bottom, prior to being brought into engagement with the shoe bottom, and also the position of the lasting rolls, widthwise of the shoe bottom, as they are caused to operate therealong as aforesaid, fluid pressure operated means being provided for thus moving the carriage, wherein operation of said fluid pressure operated means is also controlled by said control means, the control means comprising further valve means, by which the supply of pressure fluid to said fluid pressure operated means is controlled, and actuator means for the valve means, and said valve means and actuator means being mounted one on said carrier member and the other for movement with the carriage.

8. A machine according to claim 4 wherein the speed of movement of the carriage in a direction extending lengthwise of the shoe bottom can be varied during the course of such movement under the control of fluid pressure operated speed control means, and wherein operation of said speed control means is in turn controlled by control means comprising a further sensing member, mounted for movement independently of the carriage, and engageable with a further abutment member forming part of the abutment means, which further sensing member is brought into engagement with said further abutment member when movement of the carriage is initiated as aforesaid, a carrier member which is connected, through a grading arrangement, with said further sensing member, and the position of which in relation to the shoe bottom is determined by the toe end engaging member, but modified by the grading arrangement, valve means, which controls the supply of pressure fluid to the speed control means, and actuator means for said valve means, said valve means and actuator means being mounted one on said carrier member and the other for movement with the carriage.

9. A machine according to claim 7 wherein the speed of movement of the carriage in a direction extending lengthwise of the shoe bottom can be varied during the course of such movement under the control of fluid pressure operated speed control means, and wherein operation of said speed control means is in turn controlled by said control means, the control means also comprising valve means, which controls the supply of pressure fluid to said speed control means, and actuator means for said valve means, and said valve means and actuator means being mounted one on said carrier member and the other for movement with the carriage.

10. A machine according to claim 9 wherein further control means is provided whereby, as the carriage is moved in an opposite direction, the nozzles are moved heightwise of the shoe bottom, out of engagement therewith, and movement of the carriage in said opposite direction is arrested, said further control means comprising valve means and actuator means therefor, the relative positions of which remain unaffected by the setting of the abutment means.

11. A machine according to claim 10 wherein said further control means is also effective to move the lasting rolls heightwise of the shoe bottom, out of engagement therewith, after the nozzles have been moved heightwise as aforesaid.

12. A machine according to claim 11 wherein the further control means is manually adjustable.

13. A machine according to claim 7 wherein fluid pressure operated means is provided by which the carrier member can be moved in a direction parallel with that of the movement of the carriage, and wherein the grading arrangement comprises a lever to which the carrier member is connected, at a position intermediate the length of the lever, and the lever is mounted at one end of a frame portion of the machine for pivotal movement thereon, while its other end is pivotally connected to the further sensing member, the arrangement being such that movement of the carrier member is limited by engagement of the further sensing member with the further abutment member, the ratio between such movement of the carrier member and that of the further sensing member being the same as the ration between the distances between the pivot point of the lever and the points along the length of the lever at which respectively the carrier member and further sensing member are connected to the lever.

14. Apparatus according to claim 13 wherein the further sensing member is advanced into engagement with the further abutment member after the carriage has been advanced to bring the first-mentioned sensing member into engagement with the first-mentioned abutment member.

* * * * *